US005640858A

United States Patent [19]

Komenda et al.

[11] Patent Number: 5,640,858

[45] Date of Patent: Jun. 24, 1997

[54] TEXTILE MACHINE WITH MOVABLE THREAD READYING DEVICE

[75] Inventors: Martin Komenda; Reinhold Schimko, both of Westhausen, Germany

[73] Assignee: Universal Maschinenfabrik Dr. Rudolf Schieber GmbH & Co. KG, Westhausen, Germany

[21] Appl. No.: 522,399

[22] PCT Filed: Mar. 17, 1994

[86] PCT No.: PCT/EP94/00849

§ 371 Date: Dec. 4, 1995

§ 102(e) Date: Dec. 4, 1995

[87] PCT Pub. No.: WO94/21849

PCT Pub. Date: Sep. 29, 1994

[30] Foreign Application Priority Data

Apr. 18, 1993 [DE] Germany ..... 43 08 663.2

[51] Int. Cl.[6] ..... D04B 15/50

[52] U.S. Cl. ..... 66/126 R; 66/64; 66/127

[58] Field of Search ..... 66/125 R, 126 R, 66/127, 128, 129, 130, 146, 60, 64

[56] References Cited

U.S. PATENT DOCUMENTS

| | | | |
|---|---|---|---|
| 2,710,529 | 6/1955 | Piltz | 66/127 |
| 4,025,865 | 5/1977 | Zamarco | 66/127 |
| 4,700,553 | 10/1987 | Goller et al. | 66/146 |
| 4,720,985 | 1/1988 | Goller et al. | 66/146 |
| 4,840,046 | 6/1989 | Goller et al. | 66/127 X |
| 5,072,602 | 12/1991 | Naumann | 66/146 X |

FOREIGN PATENT DOCUMENTS

| | | | |
|---|---|---|---|
| 6200453 | 7/1994 | Japan | 66/146 |
| 6272141 | 9/1994 | Japan | 66/146 |

*Primary Examiner*—John J. Calvert

*Attorney, Agent, or Firm*—Limbach & Limbach, LLP

[57] ABSTRACT

A flat bed knitting machine includes a pair of needle beds arranged in a V-shape and at least one cam carriage arranged for movement relative to the needle beds. A thread readying device is movable independent of the cam carriage on a rail.

7 Claims, 2 Drawing Sheets

TEXTILE MACHINE WITH MOVABLE THREAD READYING DEVICE

DESCRIPTION

The invention relates to a textile machine including at least one arrangement, which is movable over the processing area of the machine, for supplying at least one thread to the spot at which the thread is to be processed.

BACKGROUND OF THE INVENTION

Textile machines of this type are generally known and are described for example, in the context of a flat bed knitting machine, in DE-C 36 41 182. With these textile machines, there is a difficulty in processing the thread at a constant tension, for example when knitting up or when inserting it as the final thread, in such a way that uniform, optically appealing textile goods can be produced, especially where certain requirements are desired of the product e.g. uniform stretching properties. If the tension is not even, then accordingly fewer or more of the threads will be processed in one area of the textile article whereby irregularities will occur in the textile goods so that the properties of the product such as its structure, the occurance of stretching or the impression it gives as regards colour will not be uniform. This disadvantage occurs especially when processing elasticated or rubberised yarns because, to a certain extent, differing quantities of elasticated yarn are processed due to a variation in the tension of, or to a different degree of tugging on, the elasticated yarn. A variation in the tension of the thread being processed occurs, in particular, with flat bed knitting machines, this being due to the cam carriage, and thus the yarn carrier boxes including the yarn guides and the feeder wheels, being moved first in the one and then in the other direction whereby the tugging on the thread being processed varies considerably.

SUMMARY OF THE INVENTION

Hence, the object of the invention is to develop a textile machine with which, in a simple manner, the production of uniform textile goods can be guaranteed especially when processing elasticated yarns.

The posed object is achieved in accordance with the invention by means of a device which is movable over the processing area of the machine for placing the thread in readiness. Thus, the thread which is to be processed is placed in readiness directly at the spot where it is to be processed without there needing to be any long paths for the thread, on which paths the thread may experience differing amounts of tugging. By virture of the feature in accordance with the invention, of moving the thread readying device over the processing area of the machine, a uniform tugging on the thread which is to be processed is always positively ensured so that the textile goods being produced can be produced in a uniform manner as regards the properties of the product, even when elasticated threads or yarns are being processed.

In accordance with an especially advantageous embodiment of the invention, the thread readying device comprises a thread tensioning device. Due to this, a constant tension is applied to the thread which is being processed. Alternatively, or, in addition to the thread tensioning device, the thread readying device is preferably provided with a thread braking device which supports the function of always imparting a constant tension to the thread. The use of a feed wheel mechanism is very advantageous in this case. The way in which the thread is fed out is thereby regulated in accordance with the magnitude of the tugging force on, or, the tension in the thread which is being processed so that a constant thread tension is ensured.

In accordance with an especially advantageous embodiment of the invention, the textile machine is a flat bed knitting machine having needle beds and at least one carriage that is movable over the needle beds wherein the arrangement for supplying at least one thread is a yarn carrier box which is held on and guided by at least one yarn carrier bar. As was already mentioned hereinabove, it is difficult, especially in the case of textile machines, for example, in the case of flat bed knitting machines, in which the arrangement for supplying a thread, for example a yarn carrier box, is moved backwards and forwards over the processing area of the machine, to maintain constant the tension of the thread which is to processed, because there is practically no tugging force being exerted on the thread which is to be processed following the reversal of the stroke. The use of a thread readying device, especially a thread tension regulating device possibly in the form of a feed wheel mechanism, is thus especially advantageous in this context.

In accordance with an advantageous embodiment of the invention, the thread readying device is moved over the processing area of the machine independently of the yarn carrier box. To this end, there is preferably provided a special rail for holding and guiding the thread readying device. In connection with this embodiment, the cam carriage or its carriage bail is formed in such a way that it drives the thread readying device with it in a selectable manner. For this purpose, the carriage bail comprises an additional driving device for the thread readying device.

An embodiment, in which the already available yarn carrier bars are provided for holding and guiding the thread readying device is especially advantageous. Additional rails for holding and guiding the thread readying device are thus not required. Additional devices for driving the thread readying device are also not required, because the devices already available for driving the yarn carrier boxes can also be used for driving the thread readying device.

An embodiment, in which the thread readying device is coupled to a yarn carrier box is especially advantageous. Due to this feature, a driving device for the thread readying device can be dispensed with. The thread readying device is simultaneously moved over the processing area of the textile machine, in particular, a flat bed knitting machine, due to its being driven together with the yarn carrier box.

BRIEF SUMMARY OF THE DRAWINGS

Further details and advantages of the invention will be explained hereinafter by means of embodiments taken with reference to the drawings. Therein

DESCRIPTION OF THE PREFERRED EMBODIMENT

Figure 1:
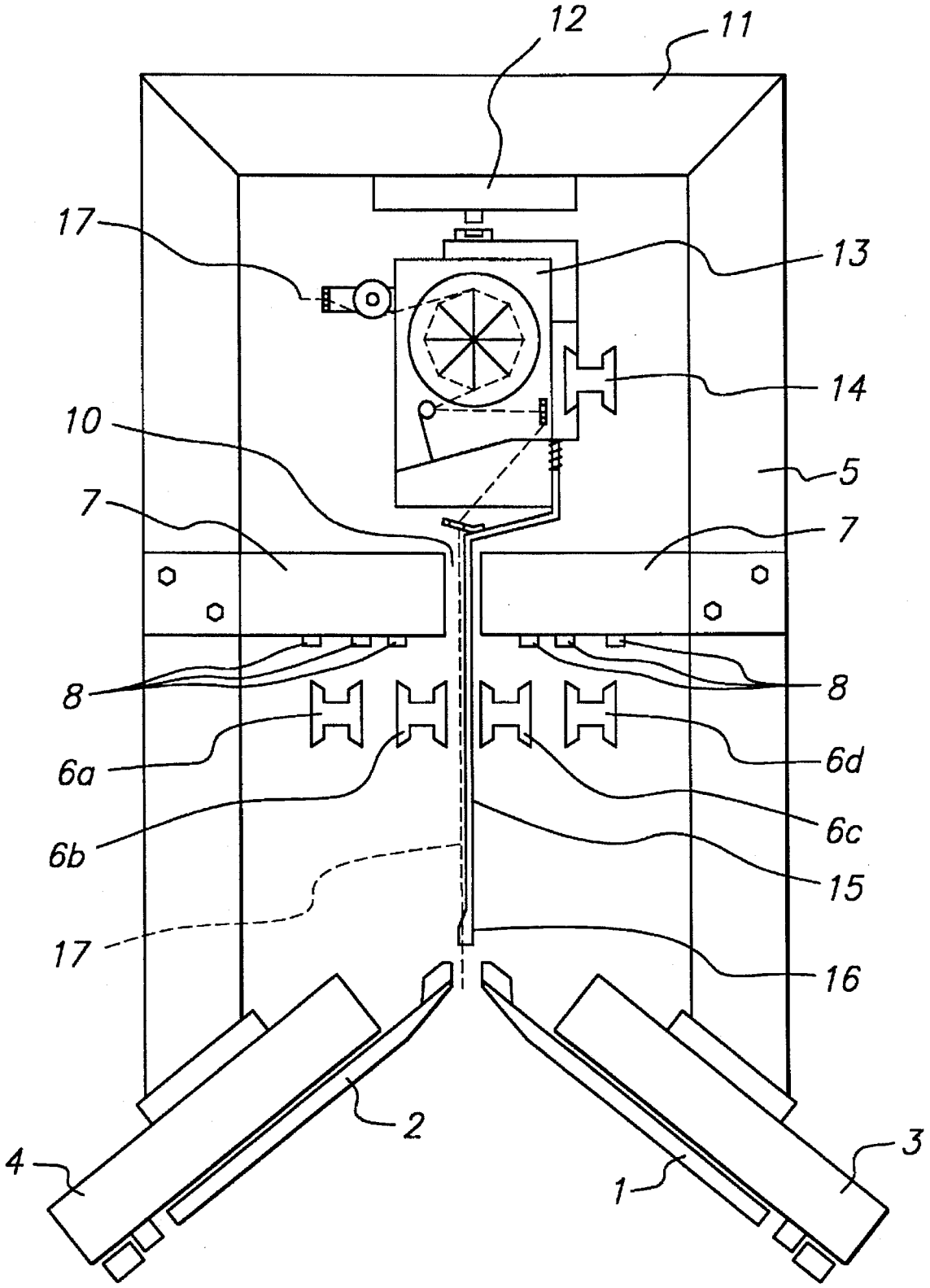
FIG. 1 shows, as a schematic illustration, an embodiment of the textile machine in accordance with the invention in which the thread readying device is held on and guided by a rail specially provided therefor and FIG. 2 an embodiment, as a schematic illustration, in which the thread readying device is held on and guided by a yarn carrier rail that is already there.

The flat bed knitting machine illustrated in FIG. 1 comprises needle beds 1, 2 over which the cam carriages 3, 4, which are connected together by a carriage bail 5, are moved. Yarn carrier bars 6a, 6b, 6c, 6d are provided for the not-illustrated yarn carrier boxes. The yarn carrier boxes arranged on these yarn carrier bars 6a, 6b, 6c, 6d can be controlled and selectively driven by yarn carrier driver devices 7, by means of the drive pins 8. An intervening space 10 between the yarn carrier driver devices 7 is left free.

The bail part 11, which connects the two vertical legs of the carriage bail 5, comprises a driver device 12 for a thread readying device 13 which is held on and guided by a rail 14 that is provided therefor. A driving pin, which emerges from the driver device 12 in a controlled and selective manner for engagement with the thread readying device 13, couples the latter to the carriage bail 5 when it has to be moved over the flat bed knitting machine.

A thread guide arm 15, upon whose lower end located directly above or in the space between the needle beds there is a feeder wheel 16, projects downwardly from the thread readying device 13 through the intervening space 10.

In the embodiment illustrated in FIG. 1, the thread readying device is a feed wheel mechanism which receives a thread 17 that is to be processed and that is supplied by a (not-illustrated) thread spool and passes this thread on to the processing area of the machine in a manner that is dependent on the tugging which is being exerted on the thread, in the present case, to the (not-illustrated) needle of the flat bed knitting machine. Feed wheel mechanisms are available commercially and do not form the subject matter of the present invention so that their manner of construction and operation do not need to be explained any further.

By virtue of the feature in accordance with the invention, of moving the thread readying device 13 over the processing area of the machine, a constant tension on the thread is ensured even when the cam carriage reverses its direction of movement. This also applies, in particular, when processing elasticated yarns for which it is particular important that a constant tension be exerted on the thread independently of the location of the cam carriage.

Figure 2:
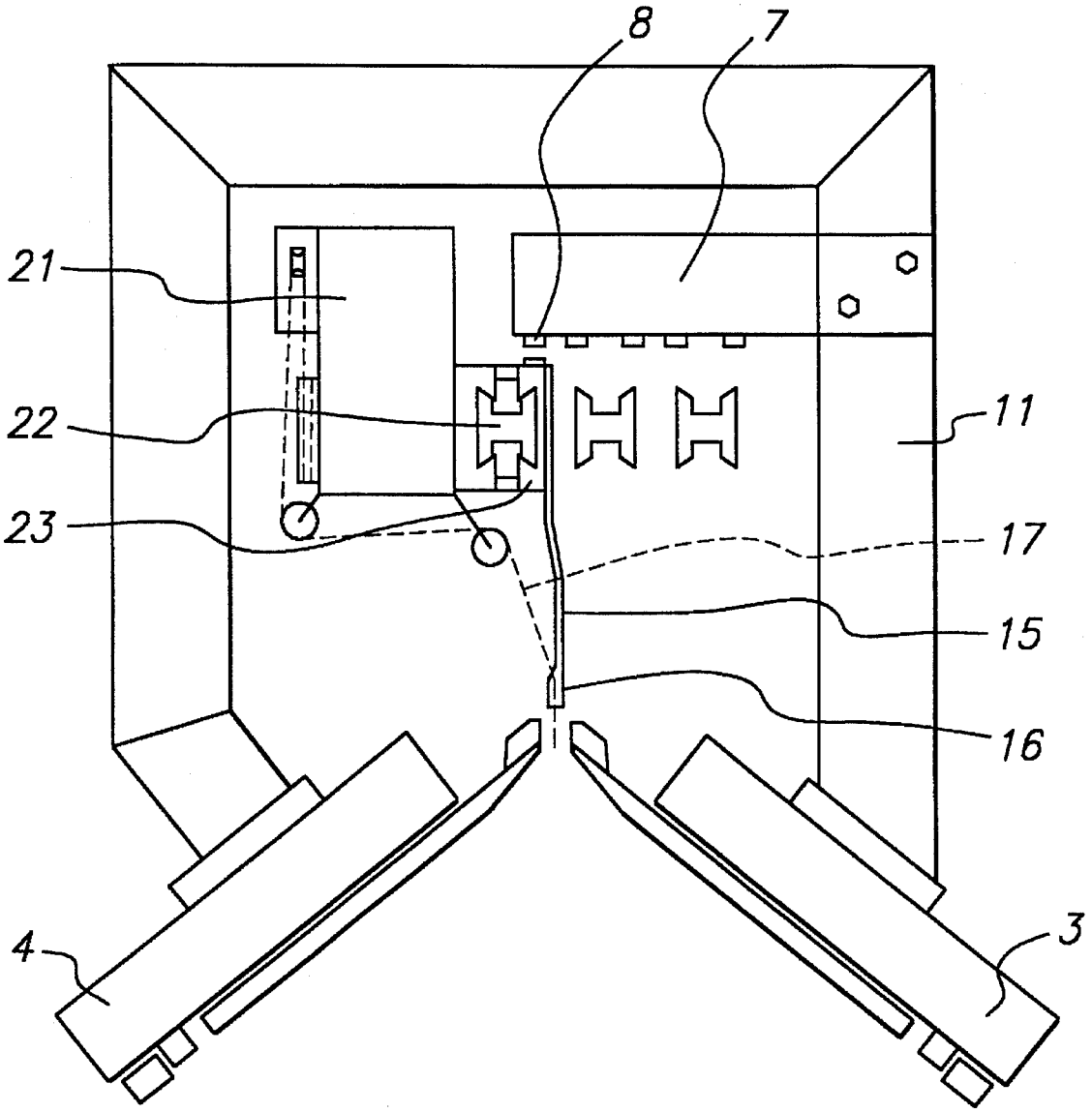

FIG. 2 shows a schematic cross-sectional illustration incorporating a partial view of the textile machine in accordance with the invention in the form of a flat bed knitting machine. In this alternative embodiment of the textile machine in accordance with the invention, the thread readying device 13 is held on and guided by a yarn carrier bar 22 that is already provided there for the yarn carrier boxes. A yarn carrier box 23 is provided on the side of the yarn carrier bar 22 remote from the thread readying device 21, the box being movable in a selective manner over the processing area of the machine together with the cam carriages 3, 4 by means of the drive pin 8 of a driver device 7 that is fixed to the carriage bail 11.

In the case of the illustrated embodiment, the yarn carrier box 23 is permanently connected to the thread readying device 21 so that the latter is moved over the processing area of the machine together with the yarn carrier box 23. However, one can conceive of a form of embodiment in which the thread readying device 21 is movable independently of the yarn carrier 23, be it by virture of a further drive pin or by means of another type of drive and control mechanism which can effect the displacement over the processing area of the machine.

The thread 17 provided by the thread readying device 21 is guided to the thread guide arm 15 of the yarn carrier box 23 and from there, to the feeder wheel 16 from where the thread 17 is then caught by the needles of the knitting machine or is inserted as the final thread.

The invention has been explained on the basis of preferred embodiments. For the skilled man however, numerous arrangements are possible without thereby departing from the inventive concept. For example, it is possible to control the thread readying device and/or the yarn carrier boxes independently of each other as regards their individual movement over the processing area of the machine, for example, by means of individual drive motors or drive belts, such as is described in the not prior published DE 43 08 251 A1 from the same applicant.

We claim:

1. A flat bed knitting machine, comprising:

a pair of needle beds arranged in the form of a V, at least one cam carriage which is movable over the needle beds, a rail having a fixed position relative to the needle beds, and at least one thread readying device which is movable along the rail for supplying at least one thread to a spot at which the thread will be processed, said thread readying device including a thread tensioning device and a thread braking device.

2. A flat bed knitting machine as in claim 1, wherein, the thread readying device comprises a feed wheel mechanism.

3. A flat bed knitting machine as in claim 1, wherein, the thread readying device is held on and guided by a yarn carrier bar.

4. A flat bed knitting machine as in claim 1, wherein, the thread readying device is mechanically connected to a yarn carrier box.

5. A flat bed knitting machine as in claim 4, wherein, the thread readying device is movable independently of the yarn carrier box.

6. A flat bed knitting machine as in claim 1, wherein, the thread readying device is coupled to a yarn carrier box.

7. A flat bed knitting machine as in claim 6, wherein the thread readying device is movable independently of the yarn carrier box.

* * * * *